US010968072B1

(12) United States Patent
Vardian et al.

(10) Patent No.: US 10,968,072 B1
(45) Date of Patent: Apr. 6, 2021

(54) AUTOMATIC DIVING TENDING SYSTEM

(71) Applicant: The United States of America as Represented by the Secretary of the Navy, Indian Head, MD (US)

(72) Inventors: Zachary Vardian, King George, VA (US); Todd Zimmerman, National Harbor, MD (US); Ramon M. Colon Montes, White Plains, MD (US); Aaron O'Toole, Oakdale, TN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 106 days.

(21) Appl. No.: 16/350,089

(22) Filed: Sep. 25, 2018

(51) Int. Cl.

| | |
|---|---|
| ***B63C 11/26*** | (2006.01) |
| ***B65H 75/48*** | (2006.01) |
| ***B65H 75/44*** | (2006.01) |

(52) U.S. Cl.
CPC ..... *B65H 75/486* (2013.01); *B63C 11/26* (2013.01); *B65H 75/4436* (2013.01); *B65H 75/4471* (2013.01)

(58) Field of Classification Search
CPC ..... B65H 75/486; B65H 75/4436; B65H 75/4471; B63C 11/26
See application file for complete search history.

(56) References Cited

U.S. PATENT DOCUMENTS

| | | | | |
|---|---|---|---|---|
| 5,173,067 | A | 12/1992 | Biba | |
| 5,938,140 | A | 8/1999 | Fundak | |
| 7,455,257 | B1 | 11/2008 | Kaleta | |
| 8,336,688 | B2 | 12/2012 | Chen et al. | |
| 2017/0211318 | A1* | 7/2017 | Chen | F16F 15/18 |

* cited by examiner

*Primary Examiner* — Sang K Kim
(74) *Attorney, Agent, or Firm* — Fredric J. Zimmerman

(57) ABSTRACT

The automatic diving tending system (ADTS) includes a buoyant sealed torsional apparatus having a plate with a perimeter seal to which is affixed a cover with a perimeter flange forming a dry buoyant cavity. On the plate is mounted a bridge supporting a drive shaft, a locking mechanism, a constant torque spring motor, and an overdrive transmission linkage. A tether spool apparatus is mounted on the exterior bottom side of the plate. It includes a frame with a guide, a spool, and coaxial connecting structure that connects to the drive shaft. A line wound on the spool that is pulled off tightens the spring motor, enabling the full length of the line to be rewound back onto the spool and to be stopped at any time by a diver.

11 Claims, 8 Drawing Sheets

AUTOMATIC DIVING TENDING SYSTEM

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to a retracting reel and in particular to an automatic diving tending system, where the system facilitates elimination of slack in a tending line, therein helping a diver with underwater communication.

2. Background

Automatic tending systems for lines have been reported in the literature, where the system includes a reel with a ratcheting means. The ratcheting means typically has a rotatable ratchet that includes a round gear with teeth, and a spring-loaded pawl on a pivot axis that engages the teeth. The teeth are uniform but asymmetrical, with each tooth having a moderate slope on one edge and a much steeper slope on the other edge. The spring-loaded pawl enables the round gear to turn in one direction, with the pawl riding over the moderate sloped edge, but not turn in the opposite direction. The spring-loaded pawl will catch against the steeply sloped edge of the first tooth it encounters, thereby locking it against the tooth and preventing any further motion in the opposite direction. Typically the pawl engages the rotating ratchet to prevent unwind of line.

Typically, the spring attached to the pawl is a tension spring, and it is stretched to its greatest tension every time it passes over a tooth's tip. Most ratchets generate an audible "click" when the pawl passes a tooth. The "click" is the sound generated when the pawl snaps into the notch between a pair of teeth on the round gear. Underwater the "click" sound may be heard by sonar and even other divers over significant distances.

The rotatable ratchet is typically used to prevent a line from being pulled off a reel, or in the case of fishing reels, only being pulled at a tension that is less than the tensile strength of the line.

Since the rotatable ratchet can only stop motion at discrete points (i.e., at tooth boundaries), the rotatable ratchet does allow a limited amount of backward motion. This backward motion is limited to a maximum distance, that is, about equal to a width of the notch between the teeth, and in some circles is called the backlash or play. The prior art teaches that in cases where backlash or play must be minimized, a smooth, toothless ratchet with a high friction surface such as rubber is sometimes used. The pawl bears against the surface at an angle so that any backward motion will cause the pawl to jam against the surface, and thus prevent any further backward motion. Since the backward travel distance is primarily a function of the compressibility of the high friction surface, this mechanism may result in significantly reduced backlash or play, but at the expense of reduced torsional locking strength.

SUMMARY OF THE INVENTION

A first object of the invention, an automatic diving tending system, is that the system utilizes very little energy. The system includes a tether spool apparatus onto which is wound the line, and the spool is fitted onto a torsional apparatus that includes a spring motor. The spring motor provides torsional energy for rewinding the line. The torsional energy is regenerated as line is pulled off the tether spool and the regenerated torsional energy is stored on the spring motor. The spring motor provides a structure for the system to conserve energy, and maintain a nearly constant torque.

A second object of the invention is that the system enables the tether spool apparatus to be swapped out with another tether spool apparatus if the tether spool apparatus becomes fouled, for example with jelly fish, detritus, knots, or normal wear and tear in an aquatic environment.

A third object of the invention is to provide a locking mechanism to stop the rewind of the line, where a diver can stop the up-take of line, and/or restart the up-take of slack in the line. The locking mechanism also may provide a communication structure with other divers and personnel on the surface.

A fourth object of the invention is to reduce the audible "clicking", by using a static ratchet in the locking mechanism, where the "clicking" is nearly eliminated, and is certainly less than a conventional ratchet. The invention isolates the clicking sound in an air and water tight cavity in the torsional apparatus that largely remains on the surface of the water. The audible "clicking" is nearly silent and therefore much more difficult to detect as air is a poorer conductor of sound than water, and the torsional apparatus is sealed.

A fifth object of the invention is that the automatic diving tending system may function without the use of electricity. Electricity introduces the possibility of shock and accelerates corrosion, especially in a salt water environment.

A sixth object of the invention is to reduce backlash or play.

BRIEF DESCRIPTION OF THE DRAWINGS

The foregoing invention will become readily apparent by referring to the following detailed description and the appended drawings in which.

DETAILED DESCRIPTION OF THE INVENTION

The automatic diving tending system (ADTS) provides a line that is readily available. The line is retractably wound onto a tether spool. The system eliminates excess slack and reduces fouling of lines that accompany slack lines. The ADTS may maintain a near constant tension, therein making it possible to communicate using line pull signals.

Figure 1:
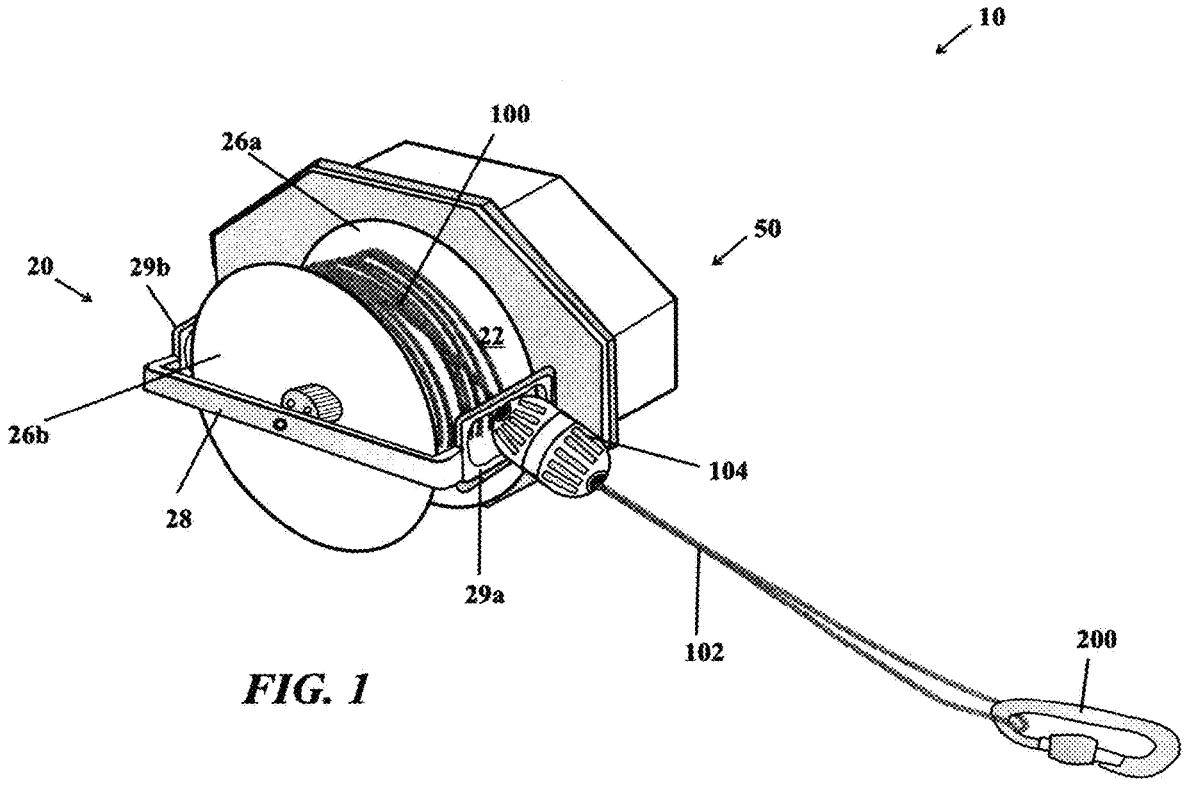
FIG. 1 is a perspective view of the automatic diving tending system on its side.
Figure 2:
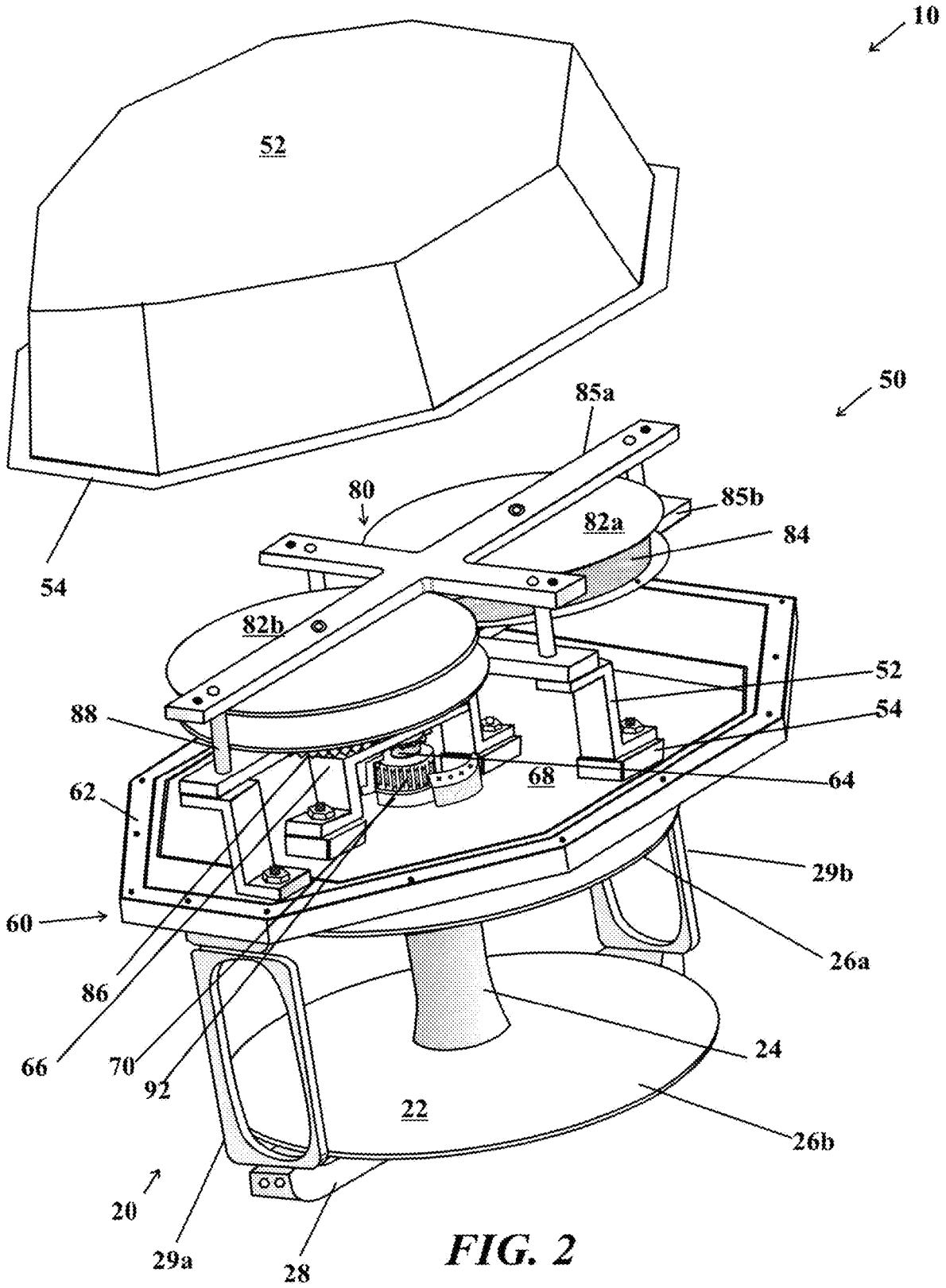
FIG. 2 is a perspective view of the automatic diving tending system that includes the buoyant sealed torsional apparatus and the tether spool apparatus, where the cover is raised.

The ADTS 10 is shown on its side in FIG. 1, and substantially upright in FIG. 2, albeit without any line and a raised cover. In use, the ADTS will generally be floating as it includes a buoyant sealed torsional apparatus 50 and a tether spool apparatus 20. The buoyant sealed torsional apparatus 50 is an upper element having a cavity that is both water and air tight remaining dry and buoyant. The tether spool apparatus 20 is a lower element that in use is substantially submerged.

Figure 3:
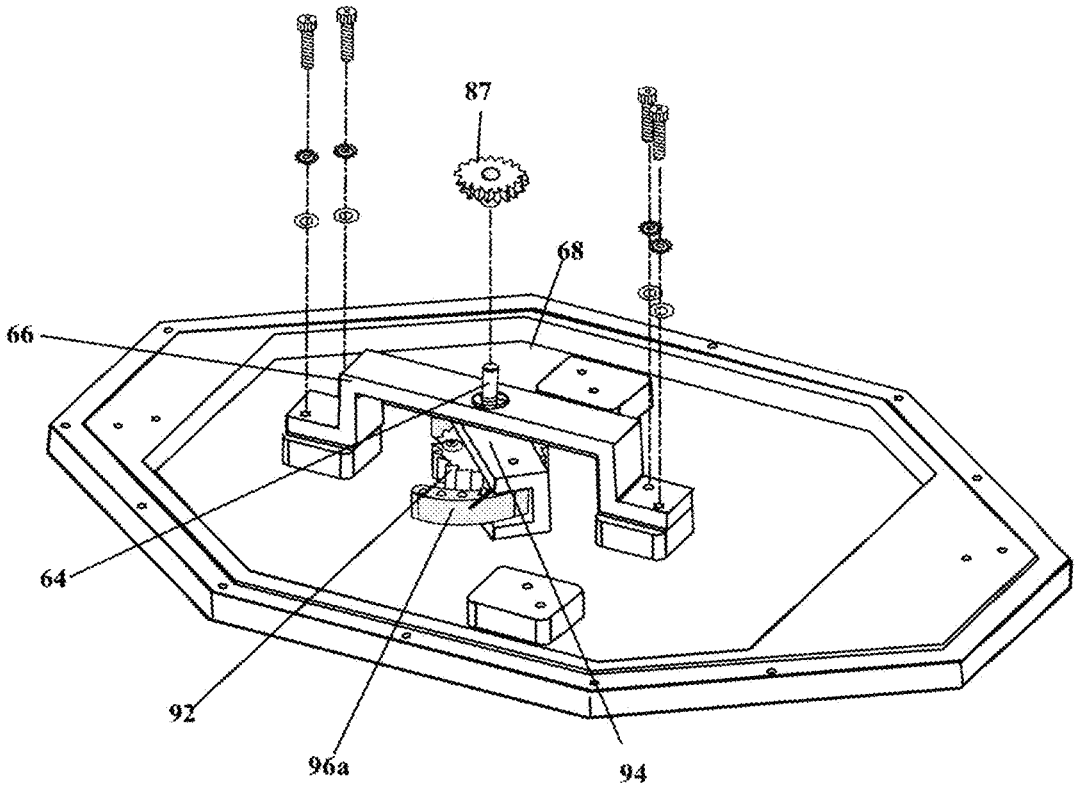
FIG. 3 is an exploded view of the plate, the drive shaft, the bridge, and a partial view of the locking mechanism.
Figure 4:
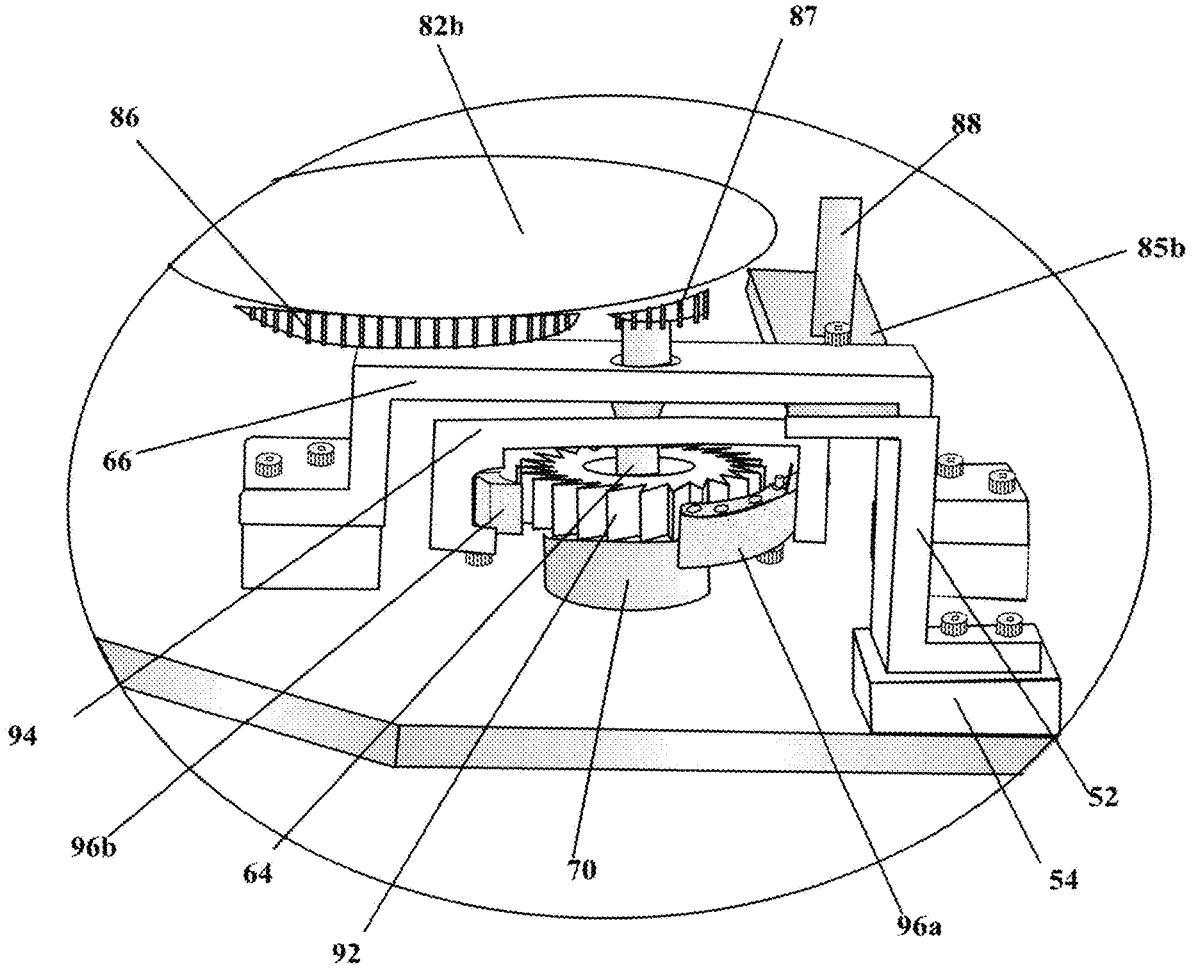
FIG. 4 is a partial view of the locking mechanism and the overdrive transmission linkage.
Figure 5:
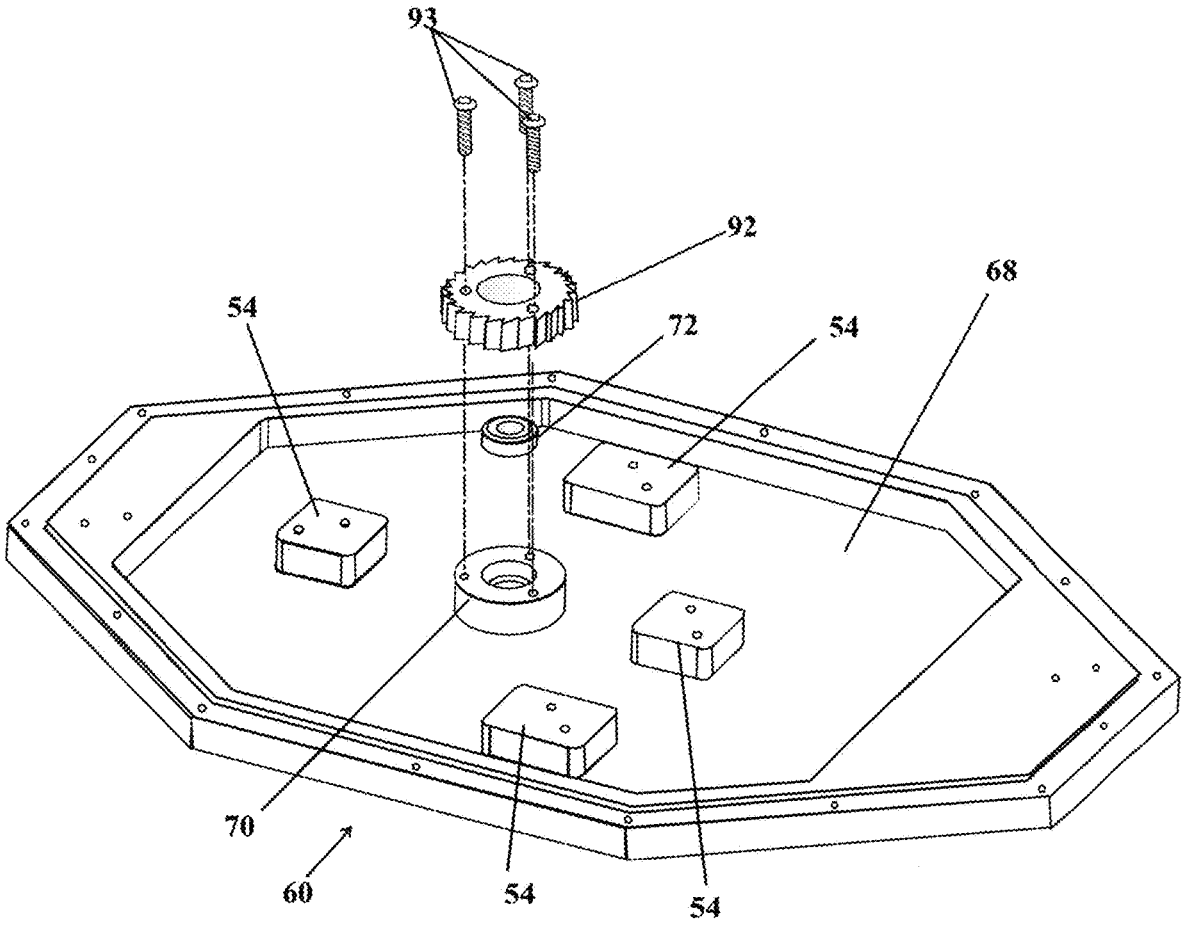
FIG. 5 is an exploded view of the static ratchet, the seal and the bearing for the drive shaft, illustrating how they are assembled on the plate.

The cavity of the buoyant sealed torsional apparatus 50 includes a cover 52 with a perimeter flange 54, which is affixed to a perimeter seal 62 of a plate 60 made of a corrosion resistant material, such as stainless steel. Mounted on the plate 60 is a bridge 66 (see FIG. 3 and FIG. 4). The bridge 66 supports a drive shaft 64 that is about perpendicular to a bottom 68 of the plate 60. The drive shaft 64 exits the buoyant sealed torsional apparatus 50 through a bearing 70 having a water tight seal 72, as shown in FIG. 5.

Returning to FIG. 2, the buoyant sealed torsional apparatus 50 includes a spring motor, and more specifically a constant torque spring motor 80 with at least a pair of reels. The illustrated spring motor 80 includes two reels, that is, an unwind reel 82*a* and a take-up reel 82*b*. A recoil spring 84 is substantially wound on the unwind reel 82*a*, and a lead portion of the recoil spring 84 extends to the take-up reel 82*b*. When the take-up reel turns forward, it winds the recoil spring 84 backwards onto the take-up reel 82*b*. The unwinding of the recoil spring requires energy, and the energy is stored in the recoil spring 84. Parenthetically, the lowest energy state of the recoil spring is when the recoil spring 84 is on the unwind reel 82*a*. The reels 82*a*,82*b* are mounted on an elevated frame between an upper crossed beam 85*a* and a lower crossed beam 85*b* separated by spacers 88. Brackets 52 and blocks 54 elevate the lower crossed beam 85*b* and attach the spring motor 80 to the plate 60.

A gear wheel 86 is flush mounted to the take-up reel 82*b*, which in turn through an overdrive transmission linkage (not visible) is connected to the drive shaft 64, which is connected to the spool 22.

Pulling line off the spool 22 forwardly rotates the drive shaft 64, which causes the recoil spring 84 to be wound on the take-up reel 82*b*, storing energy in the recoil spring 84. If the pulled off line is released, then the recoil spring initiates retraction, reversing the direction of rotation of the drive shaft 64, unless the drive shaft is locked. As the recoil spring returns to the unwind reel, the the direction of rotation of the reels and the spool is also reversed. There is enough recoil spring energy to retract all the line pulled off the spool back onto the spool 22.

Figure 8:
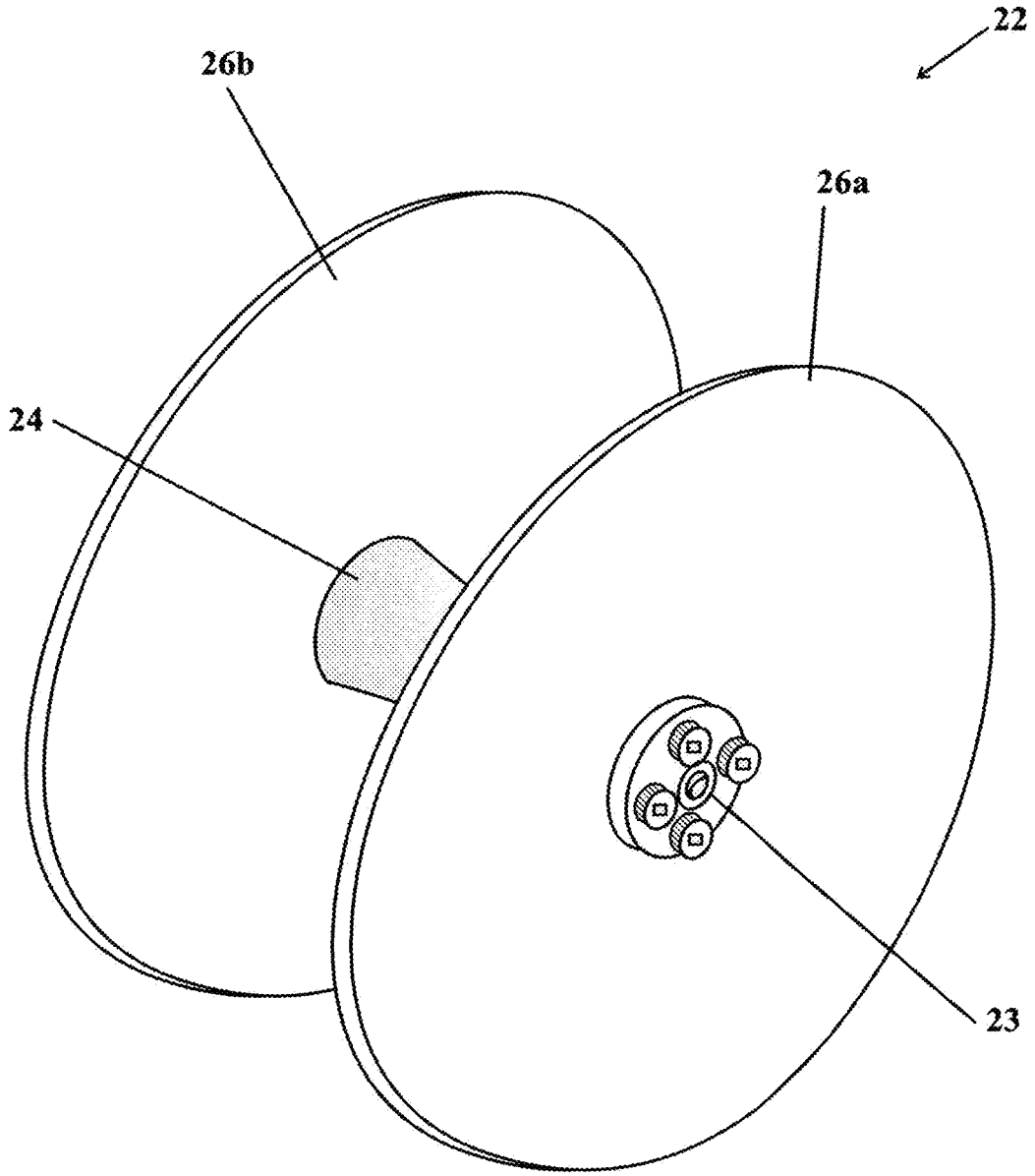
FIG. 8 is a perspective detailed view of the spool.

The spool 22 is an element of the tether spool apparatus 20. The spool 22 includes a spool shaft 24 having a mounted pair of spool walls 26*a*,26*b*, and a top-side axial connecting structure 23 (see FIG. 8). The tether spool apparatus 20 also includes a frame 28, best viewed in FIG. 1 and FIG. 2) with at least one guide 29*a*,29*b* for the line 100. The frame 28 is mounted on the bottom side 60*b* of the plate 60. The top-side axial connecting structure 23, including spool shaft 24, (as shown in FIG. 8) is connected coaxially to the drive shaft 64.

The frame 28 provides a structure to change out a spool if the line becomes fouled, for example with jelly fish, detritus, knots, or normal wear and tear found in an aquatic environment.

Torsional energy is conserved in the spring motor 80. As previously described, as line is pulled off the spool 22, the spool 22 turns, which in turn winds the recoil spring onto the take-up reel 82*b* through the drive shaft 64 and the overdrive transmission linkage. When line is retracted onto the spool 22, the rewind energy is provided by the constant torque spring motor 80 as spring energy is in the recoil spring wound backwards on the take-up reel.

The rate of retraction is dependent on a number of factors, including the length and size of the line, the weight and resistance to flow of water around any elements attached to the line, the characteristics of the spring motor and the gearing ratio of the overdrive transmission linkage. Generally, for every twelve inches (i.e. one foot) of line that is rewound onto the spool, about 1 to 3 inches of recoil spring will rewind onto the unwind reel 82*a*. From the perspective of the spring motor, this ratio is an overdrive ratio overdrive of the recoil spring length to the line length of about 1:12 to about 3:12. If the tension on the line is about 2 to 6 pounds, and the ratio of line to recoil spring is about 10, then the tension on the recoil spring is 20 to 60 pounds, not accounting for any frictional loss of the spring, transmission, drive shaft and bearings. For a diver, the tension on the line is nominally about 5 pounds or less.

As illustrated in FIG. 1, the line 100 is wound on the spool 20 at a nearly constant tension, and a lead 102 is fitted with a stop float 104 that is too large to pass through the guide 29A, 29B therein stopping the spool from winding. The stop float 104 also may be selected to impart a known resistance as it is pulled through the water. A clip 200 is attached to the lead 102, and exemplifies any of the multiple elements that may be attached to the line. It is anticipated that a plurality of ADTS may be used in concert, and that the ADTS may include other buoys and connections.

Figure 6:
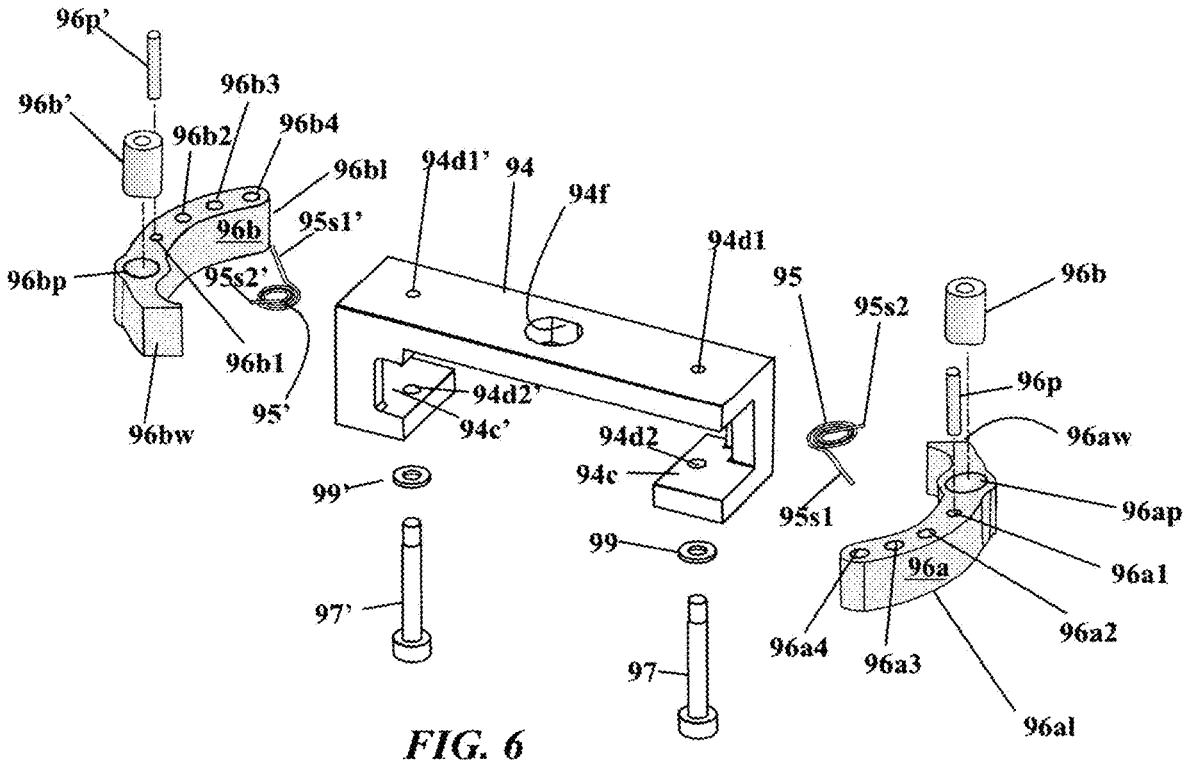
FIG. 6 is an exploded view of most of the moving elements of the locking mechanism.
Figure 7:
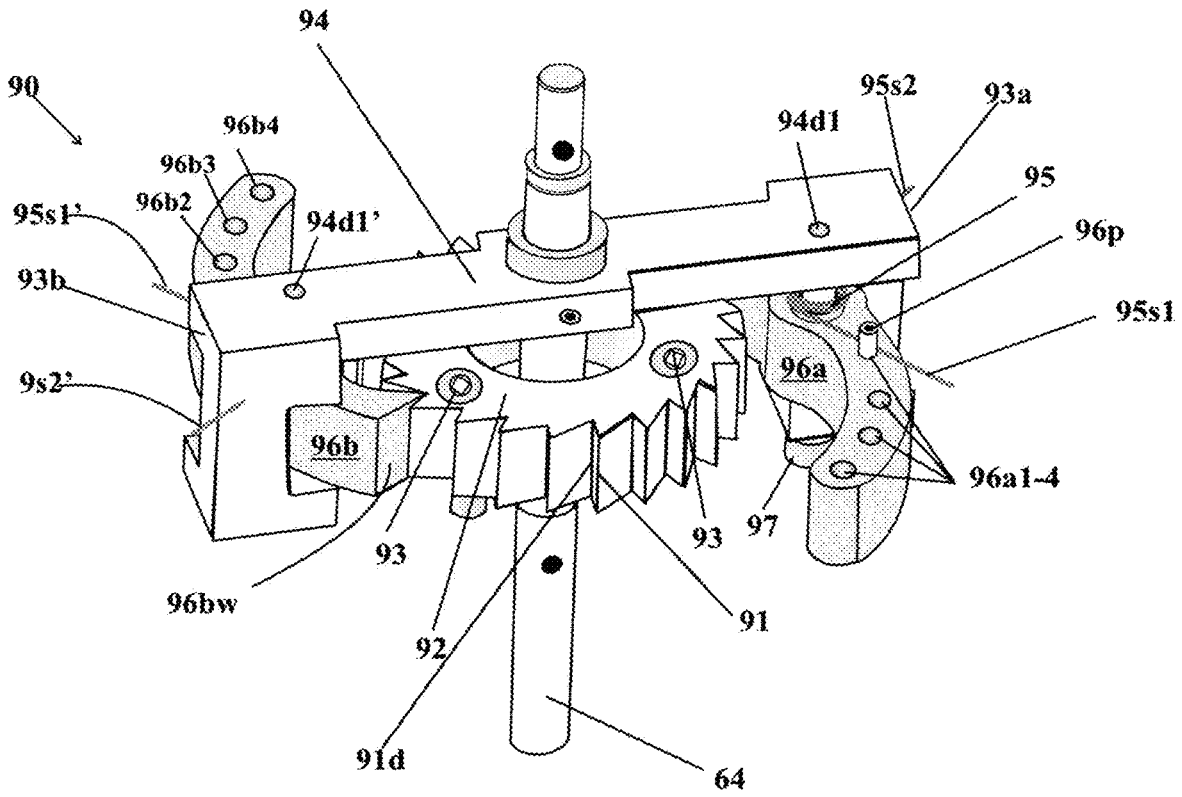
FIG. 7 is a perspective view of the assembled locking mechanism, where the wedge pawls have intersected the asymmetrical gear teeth of the static ratchet.

The invented ADTS includes a locking mechanism 90 to stop and start rewind of line as indicated in FIG. 7. The locking mechanism 90 is largely contained within the cavity of the buoyant sealed torsional apparatus 50. Elements of the locking mechanism 90 are illustrated in FIGS. 4,5,6 and 7. The locking mechanism may be remotely actuated by a diver holding the line to stop retraction of the line onto the spool. The locking mechanism 90 includes a static ratchet 92, see FIG. 5, a rotor 94 with a positive stop 94*f* (see FIG. 6), which is about centrally mounted (see FIG. 7) on the drive shaft 64, and a pair of opposing centrifugal adjustable pawls 96*a*,96*b* (see FIGS. 6 and 7). Each centrifugal adjustable pawl 96*a*,96*b* is pivotally mounted on an opposing distal end 93*a*,93*b* in FIG. 7 of the rotor 94. Each centrifugal adjustable pawl 96*a*,96*b* is springedly held away from the static ratchet by a coiled wire spring 95,95' (FIG. 6) with a straight section 95*s*1,95*s*2, 95*s*1',95*s*2'. This configuration eliminates the audible "click" of pawls riding over the asymmetrical gear teeth 91 (FIG. 7) of the static ratchet 92. Eliminating the audible "click" essentially goes a long way toward silencing the ADTS without any loss of performance and adds a margin of safety to the dive.

The static ratchet 92 is mounted on the bearing 70 mounted on the bottom 68 of the plate 60 using screws 93 (FIG. 5). The static ratchet is coaxial with the drive shaft 64 (FIGS. 4 and 7).

The rotor 94 includes a length that is sufficiently long enough so that the centrifugal pawls 96*a*,96*b* are far enough from the drive shaft 64. Accordingly, the drive shaft does not have to reach very high rpms before the centrifugal force will be strong enough to overcome a countervailing force exerted by the coiled wire springs thus preventing the pawls 96*a*,96*b* from impinging the asymmetrical gear teeth 91 of the static ratchet 92. As can be easily seen in FIG. 4 and FIG. 6, each pawl 96*a*,96*b* has an overall arch shape, with one end terminating in a wedge shape 96*aw*,96*bw* that will fit into a notch 91*d* between the asymmetrical gear teeth 91 (FIG. 7), a proximate pivot hole 96*ap*,96*bp*, and a levered lobe 96*al*,96*bl* with a series of holes 96*a*1,96*a*2,96*a*3,96*a*4 for a pinion 96*p* and recesses 96*b*1,96*b*2,96*b*3,96*b*4 for a pinion 96*p*' as shown in FIG. 6. Each levered lobe 96*al*,96*bl* terminates in a round end.

The coiled wire spring 95,95' is coaxial with the pivot hole 96*ap*,96*bp*. The coiled wire spring 95,95' has a longer section of straight wire 95*s*1,95*s*1' that is positioned against the pinion 96*p*,96*p*' mounted in the holes (a first hole 96*a*1 is shown in FIG. 7). This configuration causes the pawls 96*a*,96*b* to pivot, springedly, away from the static ratchet 92, which remains their default position/not actuated. The further distance the pinion is from the pivot point, the weaker the coiled wire spring force exerts on the pawl. The pawls pivot on a bearing 96*b*,96*b*', which is held in place by on a rotor landing 94*c*,94*c*', with a bottom hole 94*d*1,94*d*1' and a top threaded top hole 94*d*2,94*d*2' by a washer 99,97' and small bolts 97,97'. The rotor 94 is turned by the drive shaft 64.

The pair of pawls not only mechanically balance the rotor but double the chance of a fast successful engagement with the static ratchet producing a stop. This configuration further reduces backlash or play.

The locking mechanism is locked by jerking on the line then relaxing it. The jerk increases the rpm of the drive shaft and the rotor enough so that the generated centrifugal force on the pawls exceeds the countervailing force, therein individually actuating the wedge of the pawl to pivot inward into the nearest notch between the asymmetrical gear teeth on the static ratchet. The actuation stops rotation of the drive shaft and everything connected to it (including the spool, the rotor, the reels on the spring motor and the tending line). After the jerk, the rewind tension stored in the spring motor keeps the pawls pressed against a steeply sloped edge of the asymmetrical tooth of the static ratchet. This configuration prevents the pawls from pivoting back to their default unlocked position (shown in FIG. 4), as the countervailing force generated by each of the coiled wire springs is very small compared to the rewind force, and directionally certainly not strong enough to cause the rotor to move forward. Generally, both pawls on the rotor are wedged against a locking tooth on the static ratchet. However, only one pawl is required to keep the rotor and connected drive shaft from rotating.

The locking mechanism is unlocked by jerking on the line again, enabling rewinding to continue. The jerk causes each engaged pawl to back away from the steeply sloped edge of the asymmetrical tooth of the static ratchet. The jerk further allows the pawls to pivot, springedly, away from the static ratchet back to their default position.

Pulling steadily on the line, without the second jerk, may result in submerging the ADTS, depending on its buoyancy. Once the line unwind tension is high enough to overcome the rewind tension, the locking mechanism will unlock.

In general the tending line may be used to communicate to other divers along the tending line, as the line normally has little slack. The locking mechanism enables the use of line pull signals to communicate, clearly, with surface personnel as well as to control the rewind.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An automatic diving tending system (ADTS), comprising:

a buoyant sealed torsional apparatus comprising a plate having a perimeter seal to which is affixed a cover with a perimeter flange forming a dry buoyant cavity, a bridge mounted on the plate that is supporting a drive shaft, which is about perpendicular to a bottom of the plate, a locking mechanism, and a constant torque spring motor having a take-up reel with a gear wheel and an unwind reel having a recoil spring, and an overdrive transmission linkage from the gear wheel to the drive shaft; and a tether spool apparatus comprising a frame having at least one guide, wherein said frame is mounted on an exterior bottom side of the plate, wherein said frame supports and protects a spool with a spool shaft to support a pair of opposing spool walls and terminates with a topside coaxial structure connected to the drive shaft, wherein a line wound on the spool that is pulled off the spool has about a constant tension and generates a fractional length of the recoil spring to be wound onto the take-up reel of the spring motor for a length of line pulled off the spool, and wherein a slackening of the line is removed by automatic rewinding of the line onto the spool until the slackening is removed, where energy for the automatic rewinding is provided by the spring motor as a partial fractional length of the recoil spring moves back to the unwind reel.

2. The ADTS according to claim 1, wherein the locking mechanism is configured to stop, temporarily, the automatic rewinding of the line.

3. The ADTS according to claim 1, wherein the locking mechanism comprises a static ratchet with asymmetrical gear teeth mounted proximate to the plate and coaxial to the drive shaft, wherein the locking mechanism comprises a rotor mounted on the drive shaft, and centrifugally actuated pawls that, individually, are pivotally mounted on opposing distal ends of the rotor, wherein the centrifugally actuated pawls are individually adjustable and springedly held away from the static ratchet by a coiled wire spring to provide a countervailing force, therein eliminate an audible "click", wherein the locking mechanism is locked by a jerk on the line, the jerk increases the rpm of the drive shaft and the rotor to produce a centrifugal force that is greater than the countervailing force exerted on each pawl, therein to cause both centrifugally actuated pawls to pivot inward, impinge the asymmetrical gear teeth on opposing sides of the static ratchet, stop rotation of the drive shaft and elements connected to the drive shaft, and wherein the rewind tension of the spring motor keeps the pawls pressed against steeply sloped edges of an opposing set of asymmetrical teeth to prevent the pawls from pivoting back to a default unlocked position.

4. The ADTS according to claim 3, wherein the locking mechanism is unlocked by a jerk motion on the line again, temporarily, to generate an unwind tension greater than the rewind tension, cause the spool, the drive shaft and the rotor to unwind, back up the pawls so that the countervailing force is greater than the centrifugal force, which is close to about zero as the drive shaft is stopped, and allow the pawls to pivot back to their default unlocked position.

5. The ADTS according to claim 1, wherein the ADTS further comprises a lead on the line, and wherein the lead includes a stop float that is too large to pass through the at least one guide.

6. The ADTS according to claim 1, wherein the ADTS further comprises a lead on the line, and wherein the lead includes a stop float that is too large to pass through said at least one guide and impart a known resistance as it is pulled through the water.

7. The ADTS according to claim 1, wherein the overdrive transmission linkage increases the length of line to be rewound per length of recoiled spring to enable the use of higher tension recoil springs, and wherein a range of an overdrive ratio of the recoil spring length to the line length is from about 1:12 to about 3:12.

8. The ADTS according to claim 1, wherein the up-take reel and the unwind reel of the spring motor are mounted between an upper crossed beam and a lower crossed beam separated by spacers, and wherein brackets and blocks are used to elevate the lower crossed beam and secure the spring motor to the plate.

9. An ADTS, comprising:

a buoyant sealed torsional apparatus comprising a plate having a perimeter seal to which is affixed a cover with a perimeter flange forming a dry buoyant cavity, a bridge mounted on the plate that is supporting a drive shaft that is about perpendicular to a bottom of the plate, a locking mechanism, a constant torque spring motor having a take-up reel with a gear wheel and an unwind reel having a recoil spring, and an overdrive transmission linkage from the gear wheel to the drive shaft;

a tether spool apparatus comprising a frame having at least one guide, wherein said frame is mounted on an exterior bottom side of the plate, wherein said frame supports and protects a spool with a spool shaft supporting a pair of opposing spool walls, and wherein the spool shaft is terminated with a top-side coaxial connecting structure connected to the drive shaft; and a line being wound on the spool that is pulled off the spool has about a constant tension generating a fractional length of the recoil spring to be wound onto the take-up reel of the spring motor for a length of line pulled off the spool, wherein a slackening of the line is removed by an automatic rewinding of the line onto the spool until the slackening is removed, wherein where energy for the automatic rewinding is provided by the spring motor as a partial fractional length of the recoil spring moves back to the unwind reel, and wherein the line in water has very little slack, and hand signal communication is possible.

10. The ADTS according to claim 9, wherein when the locking mechanism is locked, the ADTS is submerged by slowly pulling on the line with enough force to overcome the buoyancy of the ADTS, but with less force than the rewind force.

11. The ADTS according to claim 9, wherein a plurality of ADTS are used with concerted connections to each other and buoys, and independently.

* * * * *